US006749089B2

(12) United States Patent
Stull et al.

(10) Patent No.: US 6,749,089 B2
(45) Date of Patent: Jun. 15, 2004

(54) REVERSING TRAP CONTAINER CLOSURE

(75) Inventors: Gene Stull, Far Hills, NJ (US); Robert T. Auer, E. Burg, PA (US)

(73) Assignee: Stull Technologies, Somerset, NJ (US)

( * ) Notice: Subject to any disclaimer, the term of this patent is extended or adjusted under 35 U.S.C. 154(b) by 0 days.

(21) Appl. No.: 09/749,113

(22) Filed: Dec. 26, 2000

(65) Prior Publication Data

US 2003/0057237 A1 Mar. 27, 2003

Related U.S. Application Data

(60) Provisional application No. 60/171,944, filed on Dec. 23, 1999.

(51) Int. Cl.[7] ..... B67D 1/16; B65D 25/40

(52) U.S. Cl. ..... 222/108; 222/490; 222/494; 222/499; 222/538; 222/546; 210/514; 210/538

(58) Field of Search ..... 222/490, 491, 222/494, 493, 212, 538, 109, 108, 111, 530, 498, 499, 546, 547, 564, 188; 210/514, 518, 538

(56) References Cited

U.S. PATENT DOCUMENTS 3,204,827 A * 9/1965 Krautkraemer ..... 222/143
3,232,499 A * 2/1966 Esposito, Jr. ..... 222/499
3,410,460 A * 11/1968 Musher ..... 222/490
3,669,323 A * 6/1972 Harker et al. ..... 222/490
3,674,183 A * 7/1972 Venable et al. ..... 222/212
4,133,457 A * 1/1979 Klassen ..... 222/212
4,169,548 A * 10/1979 Bond ..... 222/505
4,569,464 A * 2/1986 Wassilieff ..... 222/529
4,726,700 A * 2/1988 Gray ..... 222/109
5,071,037 A * 12/1991 Moore et al. ..... 222/109
5,411,182 A * 5/1995 Marte et al. ..... 222/386
5,927,549 A * 7/1999 Wood ..... 222/83
5,927,566 A * 7/1999 Mueller ..... 222/490
5,971,232 A * 10/1999 Rohr et al. ..... 222/494
6,089,411 A * 7/2000 Baudin et al. ..... 222/212
6,293,437 B1 * 9/2001 Socier et al. ..... 222/212
6,315,160 B1 * 11/2001 Gaiser et al. ..... 222/1
6,412,664 B1 * 7/2002 Wolff et al. ..... 222/211
6,488,186 B2 * 12/2002 Gaiser et al. ..... 222/459

* cited by examiner

*Primary Examiner*—Kevin Shaver
*Assistant Examiner*—Stephanie L Willatt
(74) *Attorney, Agent, or Firm*—Katten Muchin Zavis Rosenman

(57) ABSTRACT

The present invention relates to a closure for a container which provides for, among other things, an internal drainage system. Preferably, the closure is molded as a single integral unit that includes a base, cap and hinge arrangement joining the base and the cap and further includes a tamper-evident structure.

8 Claims, 5 Drawing Sheets

REVERSING TRAP CONTAINER CLOSURE

CROSS-REFERENCE TO RELATED APPLICATIONS

This application is a non-provisional counterpart to and claims the benefit of U.S. Application Serial No. 60/171,944 entitled, "Reversing Trap Cap" filed Dec. 23, 1999. The entire disclosure of the forgoing patent application is incorporated by reference as if set forth at length herein.

STATEMENT REGARDING FEDERALLY SPONSORED RESEARCH OR DEVELOPMENT

Not Applicable.

REFERENCE OF AN APPENDIX

An appendix is included herewith, the entire disclosure of which is incorporated by reference as if set forth at length herein.

BACKGROUND

1. Field of Invention

The present invention relates generally to container closures and, more particularly, to a closure for a flexible container which dispenses a flowable/viscous product when pressure is applied to the container and automatically closes when pressure is removed from the container.

2. Description of Related Art

Numerous valving-type closures are known in the art, examples of which include closures disclosed in U.S. Pat. Nos. 2,550,132; 2,552,715; 2,667,992; 2,670,884; 3,273,754; 3,608,793; and 4,133,457.

While the forgoing closures are functional, each suffer from one or more drawbacks involving, for example, poor dispensing characteristics, lack of a truly drip-resistant seal, or else problems that have occurred with solidified product which tended to accumulate in the area of the slit and which interfere with or defeat proper valving operation of the closure.

SUMMARY

The present invention is a solution to the forgoing unresolved problems and deficiencies of the prior art.

Therefore, in accordance with one aspect of the solution presented herein, there is generally provided designed to dispense a flowable product that is shipped and stored within a flexible wall container. In operation the container is turned upside down and pressure is applied to the outside container walls. A diaphragm affixed to the closure extends outward becoming convex and the internal product is dispensed automatically through a slit in the diaphragm. The entire inner and outer diaphragm area, including a nozzle, are molded as one piece in a soft flexible material with memory. The diaphragm is molded in a concave or inverted position and fused to the cap reservoir wall, by the means of a co-injection molding process. When the container is held in the inverted working position the internal contents move towards the inverted diaphragm. The internal liquids generated through syneresis or humidity changes will reach the inverted diaphragm or holding reservoir are a prior to the main body dollop. The unmixed liquid is drained from the interior walls or from the inverted diaphragm into the reservoir trap, as the product is dispensed.

These and other aspects, features and advantages of the solution presented herein will become better understood with regard to the following description, appended claims, and accompanying drawings.

BRIEF DESCRIPTION OF THE DRAWING(S)

Referring briefly to the drawings, embodiments of the present invention will be described with reference to the accompanying drawings in which.

DETAILED DESCRIPTION

Referring more specifically to the drawings, for illustrative purposes the present invention is embodied in the article of manufacture, i.e. product, and method of operation generally shown in FIGS. 1–6. It will be appreciated that the product and method of operation may vary as to the details of its configuration and operation without departing from the basic concepts disclosed herein.

1. Overview

The present invention relates to a closure for a container which provides for, among other things, an internal drainage system. Preferably, the closure is molded as a single integral unit that includes a base, cap and hinge arrangement joining the base and the cap and further includes a tamper-evident structure.

2. FIGS. 1–3

Figure 1:
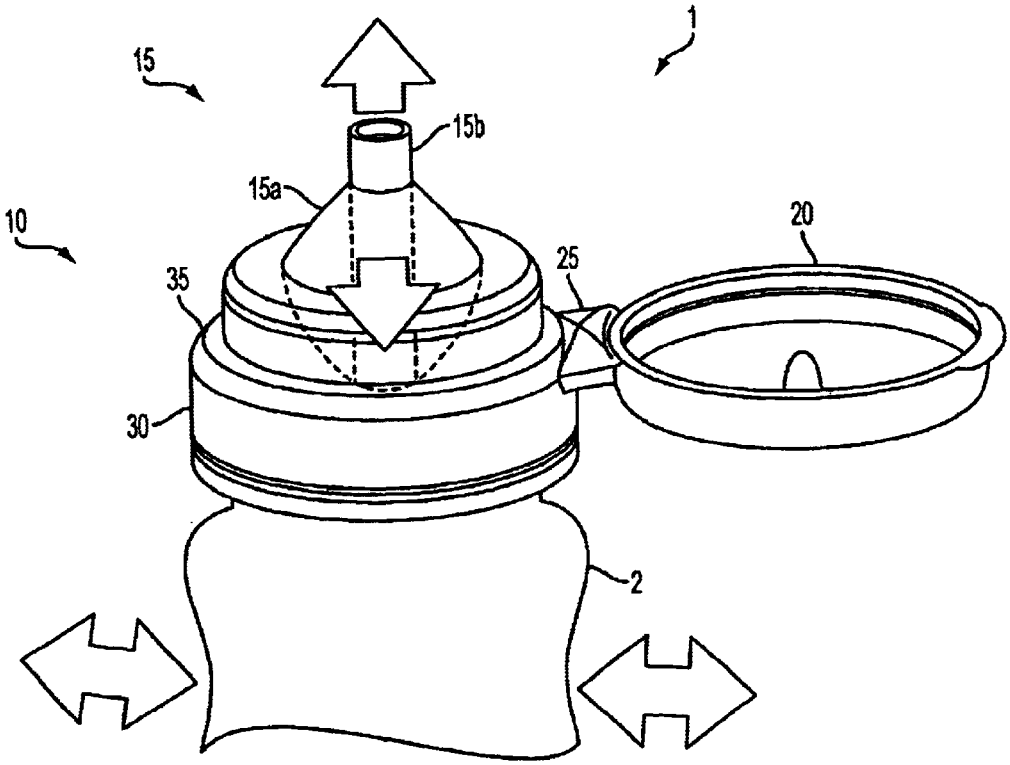
FIG. 1 illustrates a detailed view of one embodiment of the present invention.
Figure 2:
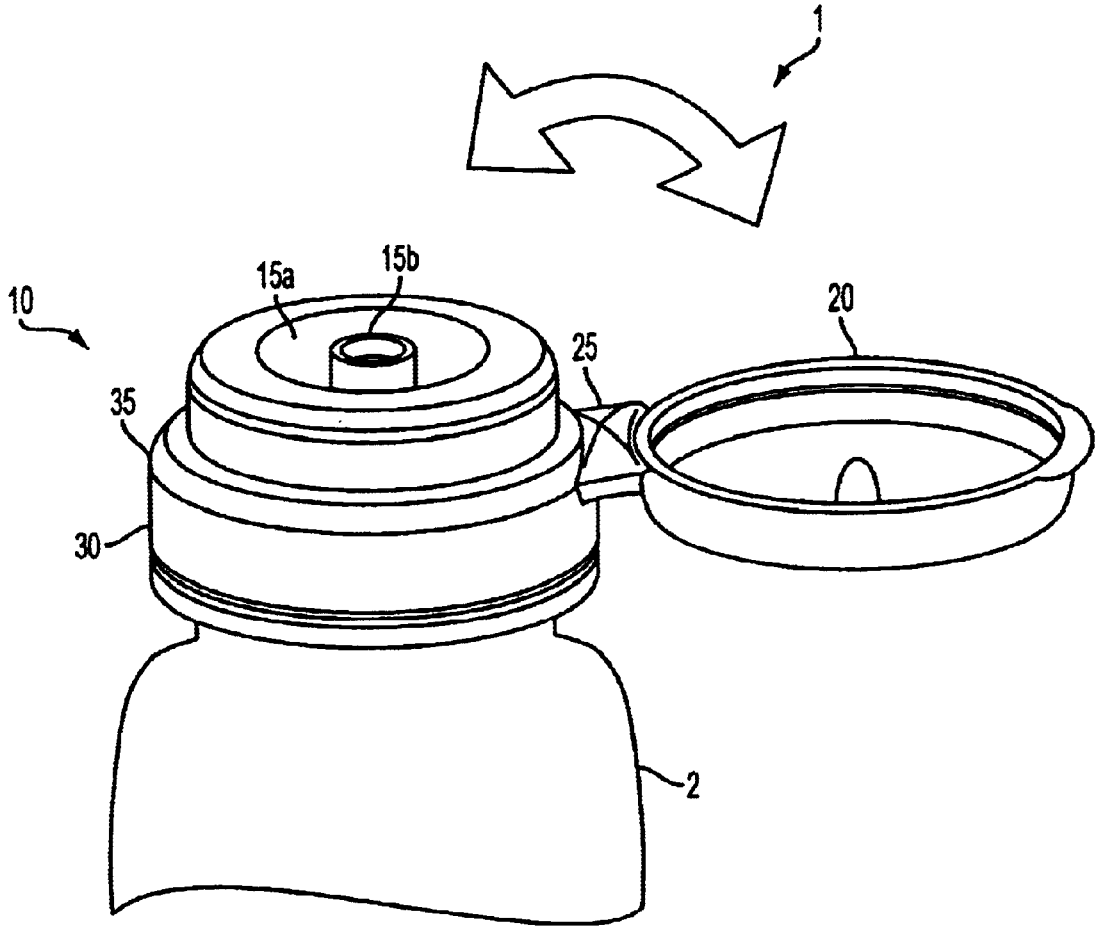
FIG. 2 illustrates a second detailed view of the embodiment of FIG. 1.
Figure 3:
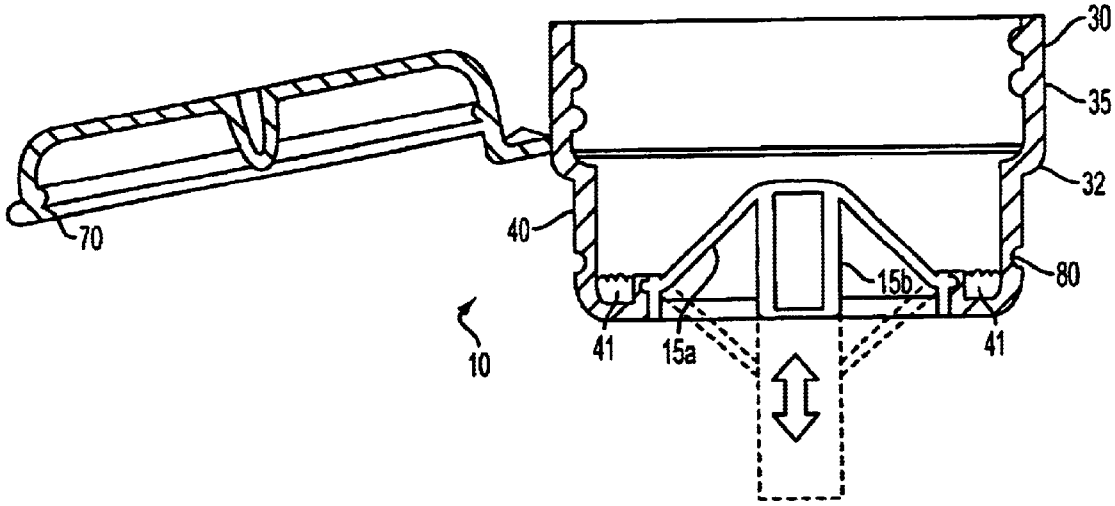
FIG. 3 illustrates a side sectional view of the embodiment of FIG. 1.
Figure 7:
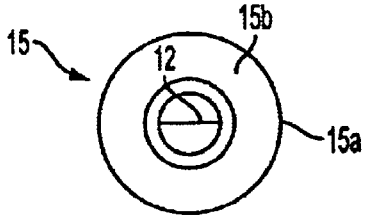
FIG. 7 illustrates a bottom view of the diaphragm assembly of FIGS. 1–3.

Referring to FIGS. 1–3, there is shown one embodiment of a closure construction generally designated by the numeral 1, comprising at least a body 10 and a diaphragm-nozzle assembly 15 having a diaphragm 15*a* and a nozzle 15*b* and a slit 12 at a base of the nozzle 15*b* (see FIG. 7, which is a bottom view of the diaphragm assembly 15 looking into the nozzle 15*b*). In a preferred embodiment, the closure 1 also includes a cap or lid 20 and a hinge or link 25. As illustrated in the Figures, closure 1 is in an open position and can be closed preferably by a water barrier snap structure comprising projection 70 matingly fitting into slot 80

The body 10 includes a base 30 having an annular depending skirt 35 and a vertical member positioned inwardly from the edge of the base 30. The annular skirt is sized to attach to a neck of a container 2.

As shown in FIG. 3, the vertical member 40 serves as a reservoir. Specifically, the interior of the vertical member opposite the lower portion of the body member 10 includes a reservoir ring 41 for catching, for example, separated liquid as it drains off the inner side walls of the expandable diaphragm-nozzle assembly (to be described in more detail below), when the product contained within the container 2 is being dispensed In one embodiment, the inner surface of the annular depending skirt 35 is preferably, further provided with internal threads (not shown) adapted to engage corresponding outer threads (not shown) on the external/outer portion of the container's 2 neck. In another embodiment, the outer surface of the annular depending skirt 35 also includes striations 45 to facilitate installation of the closure 1 onto the container 2 and removal therefrom.

As shown, the preferably, one-piece diaphragm-nozzle assembly 15 is made from a resilient and slightly deformable material and includes a diaphragm portion and a directional nozzle portion. As shown, the directional nozzle 15 is hollow and has a discharge orifice at its uppermost end. Also, included with the nozzle 15 is a non splatter recess spout. The affects of product splattering caused by air pockets in the product or by the reverberation of the diaphragm slit is eliminated by placing the slit in the diaphragm at the base of the directional nozzle. As an additional feature, the nozzle is preferably, long and narrow such that the splattering that may take place is controlled within the length of the nozzle.

As shown, the preferably, one-piece diaphragm-nozzle assembly 15 is made from a resilient and slightly deformable material and includes a diaphragm portion 15*a* and a directional nozzle portion 15*b*. As shown, the directional nozzle 15*b* is hollow and has a discharge orifice at its uppermost end. Also, included with the nozzle 15*b* is a non splatter recess spout. The affects of product splattering caused by air pockets in the product or by the reverberation of the diaphragm slit is eliminated by placing the slit 12 in the diaphragm 15*a* at the base of the directional nozzle 15*b*. As an additional feature, the nozzle 15*b* is preferably, long and narrow such that the splattering that may take place is controlled within the length of the nozzle 15*b*.

The diaphragm portion being injection molded in a thermoplastic rubber compound requires that the slitting be done in a certain direction. This is to provide optimum consumer use based on the placement of the gate or gates, depending on the product and dispensing requirements. Material shrinkage and stress loading are part of the design of the diaphragm and slit placement. This is due to the gate material flow in the mold, as it will vary from the direction of flow, to the transverse material flow and is taken into account when selecting the type of slitting.

The cap of lid 20 is constructed to easily releasably engage/disengage the base portion of the body member. In one embodiment illustrated here, the cap 20 comprises a generally flat upper lid which further includes a downwardly projecting annular skirt having an easy open finger slot attached to a portion thereto and a spout plug.

The upper lid is preferably molded flat to permit efficient storage. That is, since the one piece diaphragm-nozzle assembly 10 is molded in a concave position, the top snap cap 20 may be molded flat. This permits several containers to be stackable on the retail outlet shelves and saves shipping cube, due to the overall container height is reduced. The master carton size can also be smaller and reduce the overall shipping cost of products.

When the closures 1 is in the closed position, the spout plug is adapted to mate with the nozzle-spout assembly to also seal the spout-nozzle assembly.

A hinge or other link 25 joins the cap of lid 20 with the body 10. In one embodiment, a bow tie living hinge is used.

In a preferred embodiment, the cap or lid 20 may be snap fit assembled to the body 10 and is captively held thereon.

Also, provided is a tamper evident seal or liner which is positioned either across the mouth of the container 2 or inside the closure 1. Preferably, the tamper evident seal is adhered to the underside of base of the body 10, as is shown in FIG. 3.

3. FIGS. 4A–B AND 5

Figure 4A:
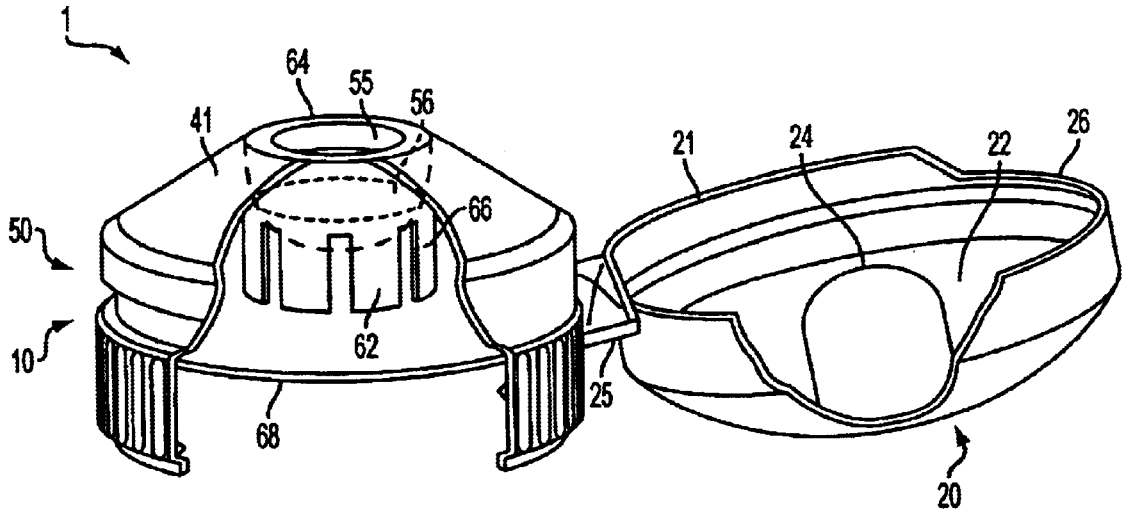
FIGS. 4A through 4B illustrate a detailed view of an alternative embodiment of the present invention.
Figure 4B:
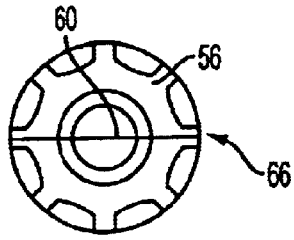
Figure 5:
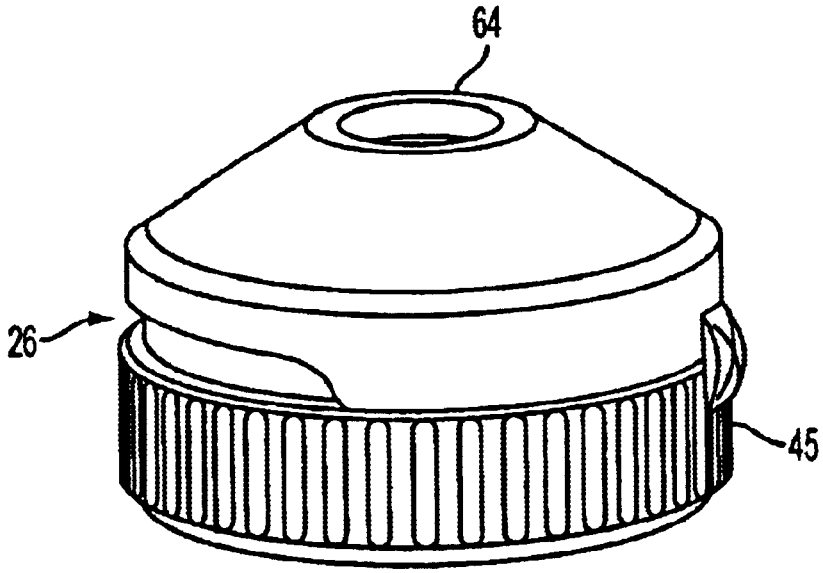
FIG. 5 illustrates a perspective view of the embodiment of FIG. 4.

Referring to FIGS. 4A–B and 5, there is shown an alternative embodiment of the closure 1. As illustrated in FIG. 4A, portions of which have been cut away for clarity of illustration, the closure 1 is in an open position. As illustrated in FIG. 5, the closure 1 is in the closed position.

Referring to FIG. 4A–B there is seen a detailed view of the closure 1 in the open position. Again as in preceding Figures, the closure 1 includes at least a body 10 and a diaphragm and nozzle assembly 15. In a preferred embodiment the closure 1 also includes a cap 20 and a hinge or link 25. The body 10 comprises a base portion 50 and a spout portion 55. Concentrically disposed within the spout portion 55 is a discharge tube 62 having it's outlet port 64 located at the top of spout portion 55.

The discharge tube 62 includes open slots 66 arranged around the bottom inner perimeter of the tube 62.

Also disposed in the discharge tube 62 is a flexible diaphragm 56 having a slit 60. The slit 60 in the diaphragm 56 is preferably, positioned at the base of the discharge tube 62. Preferably, the diaphragm 56 is tapered. When pressure is applied to the walls of the container, the expanded diaphragm opens evenly due to the half round bead on the bottom (not shown).

The cap 20 is constructed to easily releasably engage/disengage the base portion of the body member. In the embodiment illustrated here, the cap 20 comprises a lid having an annular skirt 21 and a spout plug 22 having a rounded end 24.

The base portion of the annular skirt 21 has a discontinuity such that when the cap engages the body of the closure 1 and is in the closed position—as seen in FIG. 5—a portion of the spout 55 opposite the hinged side is exposed. This feature provides for an easy open finger slot 26.

When closure 10 is in the closed position, the spout plug 22 is inserted into the top portion of spout 55. This fit between the spout plug 22 and the discharge tube 62 provides a seal, thereby providing an additional closure and seal means to prevent spillage or leakage of product through the discharge tube 62.

Also, provided in this embodiment is a tamper evident seal or liner 68 which is preferably, adhered to the underside of the base of the body 10, as is shown in FIG. 4A.

4. FIG. 6

Figure 6:
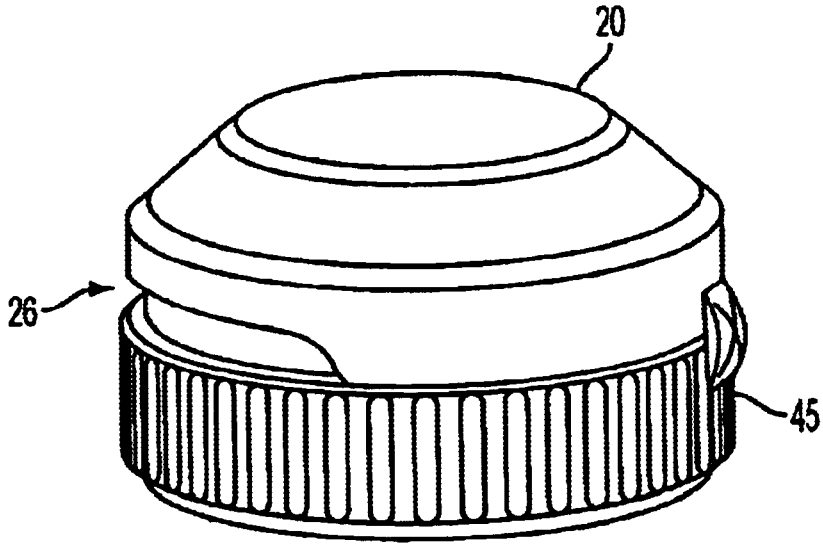
FIG. 6 illustrates a perspective view of another embodiment of the present invention.

Referring to FIG. 6, there is shown still another alternative embodiment of the present invention wherein the closure 1 is in the closed position. Here, the cap or lid 20 does not include the spout plug.

5. Method of Operation

By turning the entire container upside down and facing the nozzle downwards the one piece diaphragm and nozzle can be pressure activated by the user. By squeezing the outer wails of the shipping container, the concave diaphragm and nozzle extend out and become convex. With slightly more pressure the internal product is released through the diaphragm slit. When the container side wall pressure is stopped and the pressure momentarily reversed, the slit automatically closes, stopping the dispensing and the nozzle returns to it's original inverted molded position.

The internal drainage system is based on turning the container upside down prior to product usage. The location of the reservoir ring allows the separated liquids to drain into the ring from the walls and from the inverted diaphragm, prior to the product being dispensed. This liquid is held in the reservoir ring while the product is being dispensed.

6. Conclusion/Alternatives

Having now described a preferred embodiment of the invention, it should be apparent to those skilled in the art that the foregoing is illustrative only and not limiting, having been presented by way of example only. All the features disclosed in this specification (including any accompanying claims, abstract, and drawings) may be replaced by alternative features serving the same purpose, and equivalents or similar purpose, unless expressly stated otherwise. Therefore, numerous other embodiments of the modifications thereof are contemplated as falling within the scope of the present invention as defined by the appended claims and equivalents thereto.

For example, the closure construction may be of any convenient size, the only requirement being that it should be of a size which fits appropriately with the container 2. Moreover, the shape of the closure 1 is not critical, as other shapes may also be possible. In addition, the diaphragm and/or diaphragm-nozzle assembly may be made of a thermoplastic elastomer, such as Dynaflex® G7736 which is manufactured by GLS Corporation. Moreover, while the closure 1 is preferably molded as a single integral unit or one-piece unit, the invention is not limited thereby and can also be molded as multi-piece unit.

What is claimed is:

1. A pressure activated nozzle dispensing and self-draining valve for product packaging having a container with a discharge opening therein, said valve comprising:

a valve portion shaped to selectively extend from the discharge opening of the container following deformation;

a valve head portion having an orifice formed through a flexible diaphragm within a flex nozzle which opens and closes to control material flow through said flex nozzle, said flex nozzle flexibly extending from said valve portion following deformation and further comprising a countersunk valve;

a valve portion drainage structure draining a portion of said material flow in a radial direction with respect to said valve head portion;

said valve portion drainage structure further comprising at least one reservoir ring formation and a connector skirt portion, said connector skirt portion further comprising a marginal end area thereof connected with said container, said connector skirt portion further comprising a hinge connector extending to a sealing structure comprising a cap; said sealing structure further comprising a material barrier wall structure; and said cap comprising a plug construction to seal said valve head portion.

2. The pressure activated nozzle in accordance with claim 1, said valve further formed of a thermoplastic elastomeric material.

3. The pressure activated nozzle in accordance with claim 1, wherein said diaphragm comprises a slit at a base of the flex nozzle; and said cap further comprises a rounded plug construction.

4. The pressure activated nozzle in accordance with claim 1, wherein said container is an injection-molded body and said cap further comprising at least a slot for selectively opening said cap.

5. The pressure activated nozzle in accordance with claim 1, wherein said cap is further formed with said valve and said container as a unit to be stackable.

6. The pressure activated nozzle in accordance with claim 1, wherein said portion of said material flow being drained is a thin liquid separated from said material.

7. A dispensing valve extensible structure with a reservoir structure for a squeeze-to-open hand-held dispenser container, said valve structure comprising:

a dispensing end nozzle defining an orifice within a flexible diaphragm;

said nozzle flexibly extending and retracting from a flexible valve wall responsive to material flow pressure to extend or retract from a material flow due to said material flow pressure from within said container into said nozzle;

a portion of said material flow directed to a reservoir structure attached to said valve wall which directionally traps said portion of said material flow into said reservoir structure;

said reservoir structure further comprising at least a ring;

said reservoir structure providing material flow drainage; said reservoir structure connecting to a water barrier snap lock connecting to a container skirting structure;

said connection further comprising molding said flexible valve to a container or detachably connected; and said container skirting structure further comprising a hinged cap with sealing structure comprising a plug selectively sealing said nozzle orifice.

8. A dispensing valve extensible structure in accordance with claim 7, wherein said portion of said material flow being directed to said reservoir structure is a thin liquid separated from said material.

* * * * *